US005625998A

United States Patent [19]

Madsen

[11] Patent Number: 5,625,998

[45] Date of Patent: May 6, 1997

[54] BOX-SHAPED SELF-SUPPORTING BUILDING UNIT AND A METHOD OF CONSTRUCTION THEREOF

[75] Inventor: Jan Madsen, Odense, Denmark

[73] Assignee: S-System Modules Limited, Skanör, Sweden

[21] Appl. No.: 491,997

[22] PCT Filed: Jan. 18, 1994

[86] PCT No.: PCT/DK94/00031

§ 371 Date: Jul. 18, 1995

§ 102(e) Date: Jul. 18, 1995

[87] PCT Pub. No.: WO94/16160

PCT Pub. Date: Jul. 21, 1994

[30] Foreign Application Priority Data

Jan. 18, 1993 [DK] Denmark ..... 9200156

[51] Int. Cl.[6] ..... E04G 21/14; E04B 1/14

[52] U.S. Cl. ..... 52/745.03; 52/79.12

[58] Field of Search ..... 52/653.1, 236.3, 52/745.03, 745.16, 745.19, 79.12

[56] References Cited

U.S. PATENT DOCUMENTS

| | | | |
|---|---|---|---|
| 3,442,056 | 5/1969 | van der Lely . | |
| 3,517,468 | 6/1970 | Woods . | |
| 3,940,890 | 3/1976 | Postlethwaite . | |
| 4,644,708 | 2/1987 | Baudot et al. | 52/79.1 X |
| 4,854,094 | 8/1989 | Clark | 52/79.1 |

FOREIGN PATENT DOCUMENTS

| | | | |
|---|---|---|---|
| 404330135 | 11/1992 | Japan | 52/79.1 |
| 560296 | 3/1975 | Switzerland . | |
| 2040334 | 8/1980 | United Kingdom . | |
| 2084213 | 4/1982 | United Kingdom . | |

*Primary Examiner*—Carl D. Friedman
*Assistant Examiner*—Yvonne Horton-Richardson
*Attorney, Agent, or Firm*—Jacobson, Price, Holman & Stern, PLLC

[57] ABSTRACT

A box-shaped, self-supporting building unit, a plurality of which may be arranged juxtaposed and/or superposed for the construction of a building, the unit including a self-supporting floor element and a self-supporting ceiling element, both having a supporting structure, and two pairs of opposite wall elements as well as a supporting, vertical column of sectional iron in each corner, the column rigidly connecting the supporting structure of the floor element with the supporting structure of the ceiling element.

9 Claims, 6 Drawing Sheets

1
2
3
4
5
5
5
5
6
6
6
7
7
8
8
9
9

BOX-SHAPED SELF-SUPPORTING BUILDING UNIT AND A METHOD OF CONSTRUCTION THEREOF

TECHNICAL FIELD

The invention relates to a box-shaped, self-supporting building unit, a plurality of which may be arranged juxtaposed and/or superposed for the construction of a building, said unit comprising a self-supporting floor element and a self-supporting ceiling element, both having a supporting structure, and two pairs opposite wall elements as well as a supporting, vertical column of sectional iron in each corner, said column rigidly connecting the supporting structure of the floor element with the supporting structure of the ceiling element.

BACKGROUND ART

Building units of the above type are known having supporting walls and of which the ceiling and floor are constructed as a wooden structure supported by the walls. The known building units are constructed in accordance with traditional construction methods.

Furthermore, GB-A-2 040 334 discloses a box-shaped, self-supporting building unit comprising a bottom element consisting of a frame and a plate and an upper element consisting of a frame and a plate, and four corner columns mutually joining together the bottom element and the upper element. When the building unit is to be assembled, said elements are initially assembled to a rigid supporting frame, which is subsequently transported to the building site, at which several such building units or frames are joined together, whereafter a number of operations are to be carried out, such as fitting of inner sheating, isolation and cladding.

Finally, U.S. Pat. No. 3,442,056 discloses a prefabricated building section comprising a floor element and a ceiling element comprising profiled metal beams forming a framework about the edge of the respective elements, and a wall element comprising profiled metal beams or columns along the lateral edges thereof.

When the building section is assembled, the wall elements arranged on the floor elements at the abutting beams thereof secured to each otheer, for instance by welding. Finally, the ceiling element is arranged on top of the wall elements and the abutting beams thereof secured to each other by welding.

DISCLOSURE OF THE INVENTION

The object of the invention is to provide a method of the type stated in the introduction, which can be carried out in a rational manner and under controlled conditions regardless of the weather and the building site conditions.

For obtaining said object the building unit according to the invention is characterised by the features sates in the characterising part of claim 1.

Since the building unit consists of separate elements, it is possible to factory-prefabricate these with great accuracy in a very rational manner. Similarly, the elements forming the units may be assembled and completely mounted in the factory for formation of the finished units, which then may be transported to and assembled on site. As the wall elements can bear the ceiling element, it is possible to defer the mounting of the supporting columns, until the rest of the unit is completely assembled, whereby a the individual elements may be completed to significantly higher degree in the factory than hitherto prior to the joining together of the units on the site. It is thus possible to complete the ceiling element as well as the floor element prior to the assembly thereof and to provide the wall elements with inner sheating. As a result, the interior of the separate building units may be completed in the factory prior to the mounting on site. Overall, a substantial gain in effeciency is obtained.

According to the invention, the wall sections may be arranged abuttingly in such a manner that a vertical cavity is formed for receiving the columns.

Further, according to the invention, the supporting structure of the floor element may comprise two longitudinal bearing side members and a plurality of transverse girders arranged therebetween.

Moreover, according to the invention, the supporting structure of the ceiling element may comprise two longitudinal bearing side members and a plurality of transverse girders arranged therebetween.

Furthermore, according to the invention, at the above embodiment said transverse girders may be connected at each end to a longitudinal girder which is attached to the bearing side members.

Moreover, according to the invention, the bearing side members may be C-iron sections.

Furthermore, according to the invention, the longitudinal girders may be of U-iron sections and the transverse girders may be C- or U-iron sections with an outer sectional width essentially corresponding to the inner sectional width of the U-iron section.

Moreover, according to the invention, the columns may preferably have a rectangular and in particular a square cross-section.

Furthermore, according to the invention, the columns may be joined to the supporting structure of the floor and ceiling elements by means of welding. According to the invention, the wall elements may be arranged abuttingly in such a manner that a vertical cavity is formed for receiving the columns.

The building unit according to the invention may be utilized for all types of construction of uniform units, such as houses, hotels, colleges and the like, said unit being explained in greater details below with reference to the drawing.

BEST MODE FOR CARRYING OUT THE INVENTION

Figure 1:
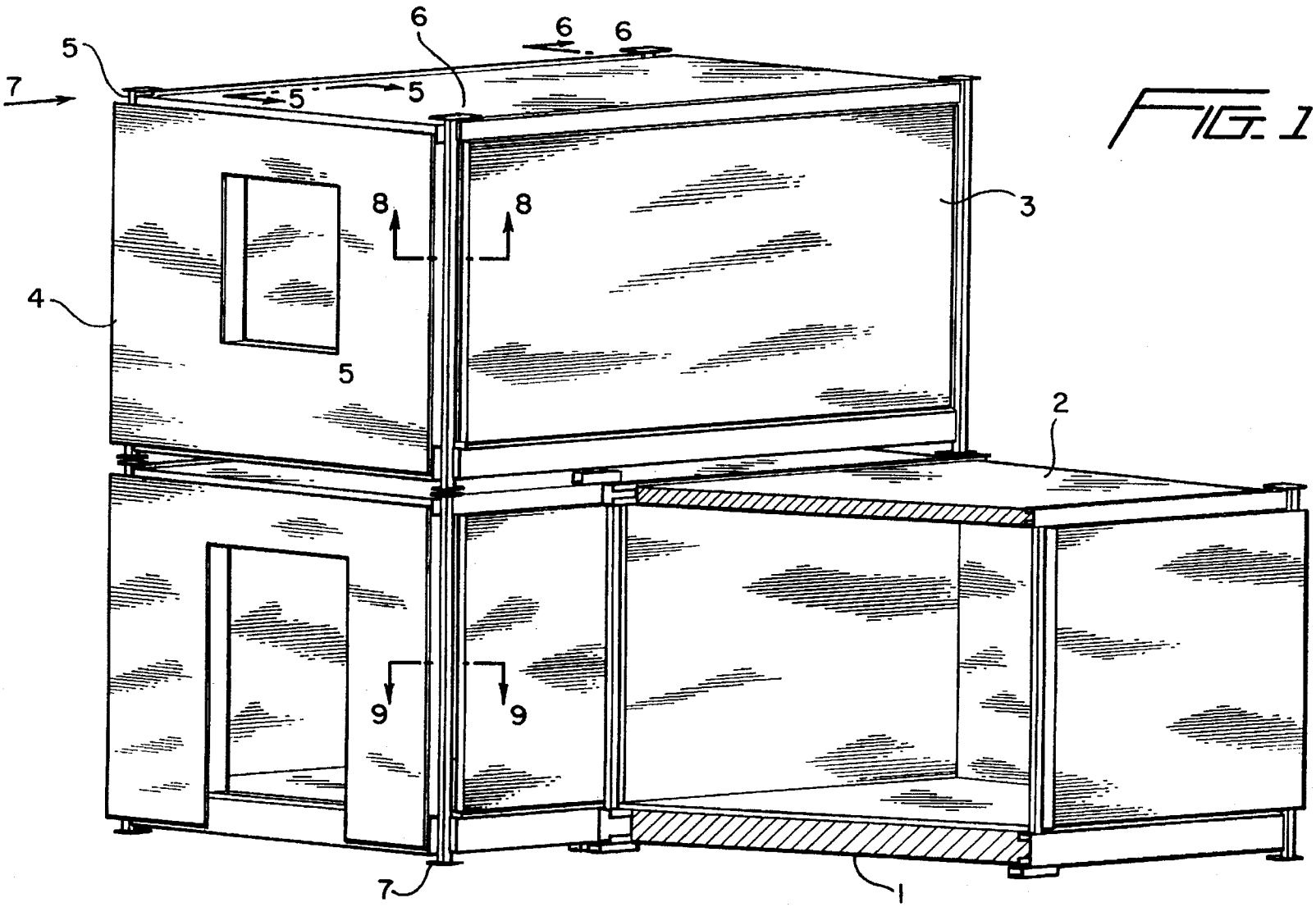
FIG. 1 is a perspective view of three building units according to the invention arranged superposed and juxtaposed, respectively.

As it appears from FIG. 1, building unit comprises a floor element 1 and a ceiling element 2 and in each of the four corners a column 5 rigidly connecting the floor element 1 and the ceiling element 2 and intended to receive the vertical forces to which a building unit is subjected. Each column 5 being a hollow iron section with a rectangular cross-section comprises at its upper end a projecting upper plate 6 and at its lover end a projecting bottom plate 7. The upper plates 6 and the bottom plates 7 are arranged superposed when stacking two building units and are interconnected by means of bolts extending through openings in said plates. Finally, each building unit comprises a pair of side walls 3 and a pair of end walls 4 and possible inner light partitions.

Figure 2:
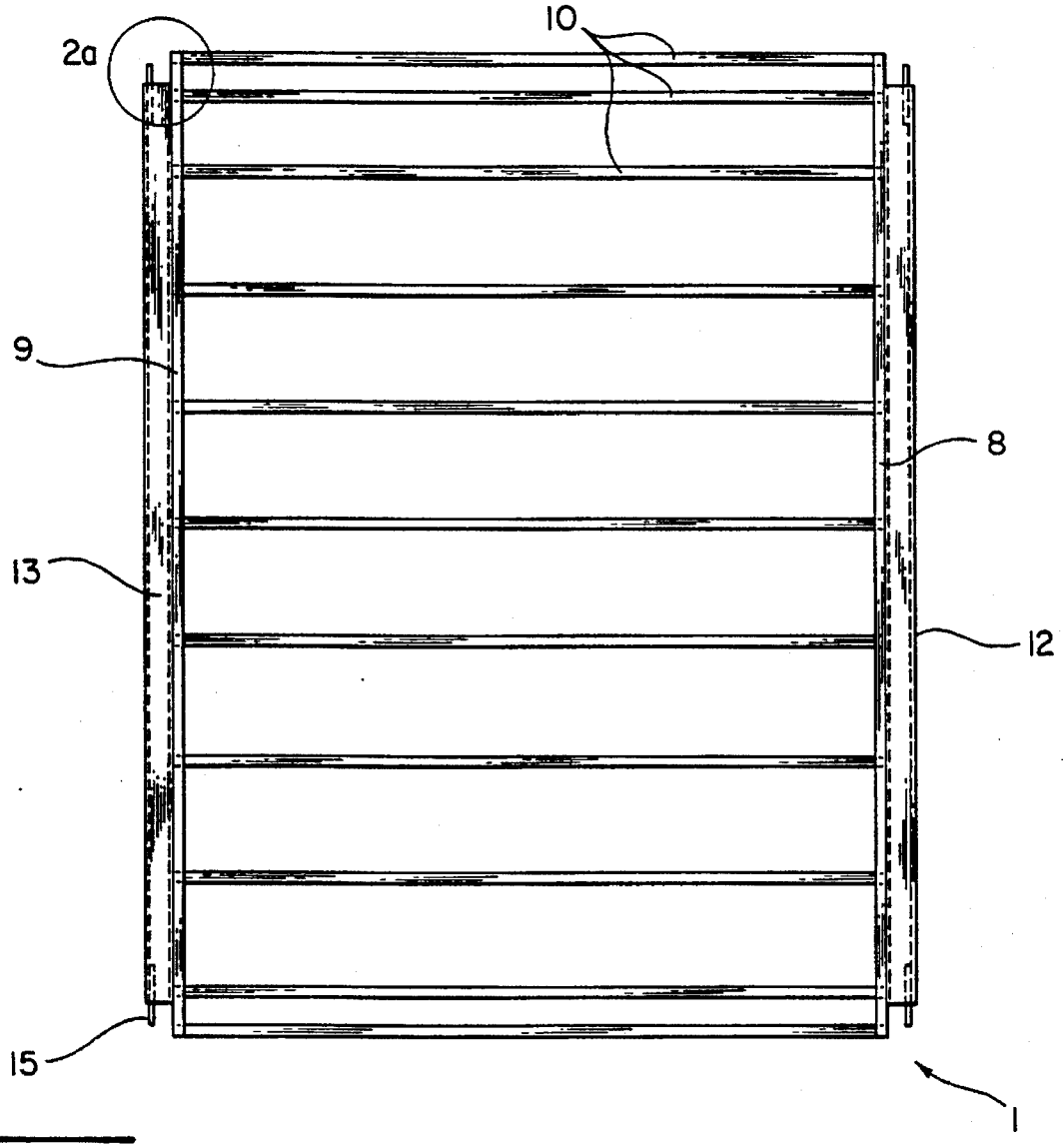
FIG. 2 is a top view of a floor element of the building unit.
Figure 2A:
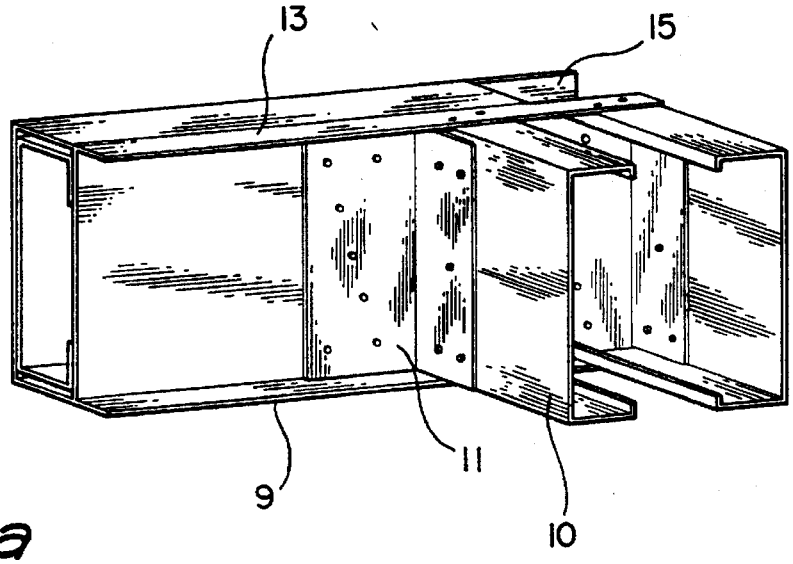
FIG. 2*a* is a perspective view of the detail 2*a* in FIG. 2.

As seen in FIGS. 2 and FIG. 2*a*, the floor element 1 has a supporting structure of sectional iron. The shown supporting structure comprises two longitudinal iron girder 8,9 having a U-shaped cross-section and a plurality of transverse girders 10 having a C-shaped cross-section and extending in between the longitudinal girders. The transverse girders have such a width that they may be inserted into the cavity of the longitudinal girders 8,9. The transverse girders 10 are attached to the longitudinal girders 8,9 by means of angle irons 11, which are fixed by means of self-cutting screws. On the outer face of each of the longitudinal girder 8,9, a C-shaped iron section or side member 12,13 is arranged with the opening facing the adjacent longitudinal girder 8,9. The C-shaped iron section or side member 12, 13 is fixed to the longitudinal girders 8,9 by means of self-cutting screws passed through the angle iron 11. Finally, at each end of the side members 12, 13, a fish plate 15 is provided on the inner side.

Figure 3:
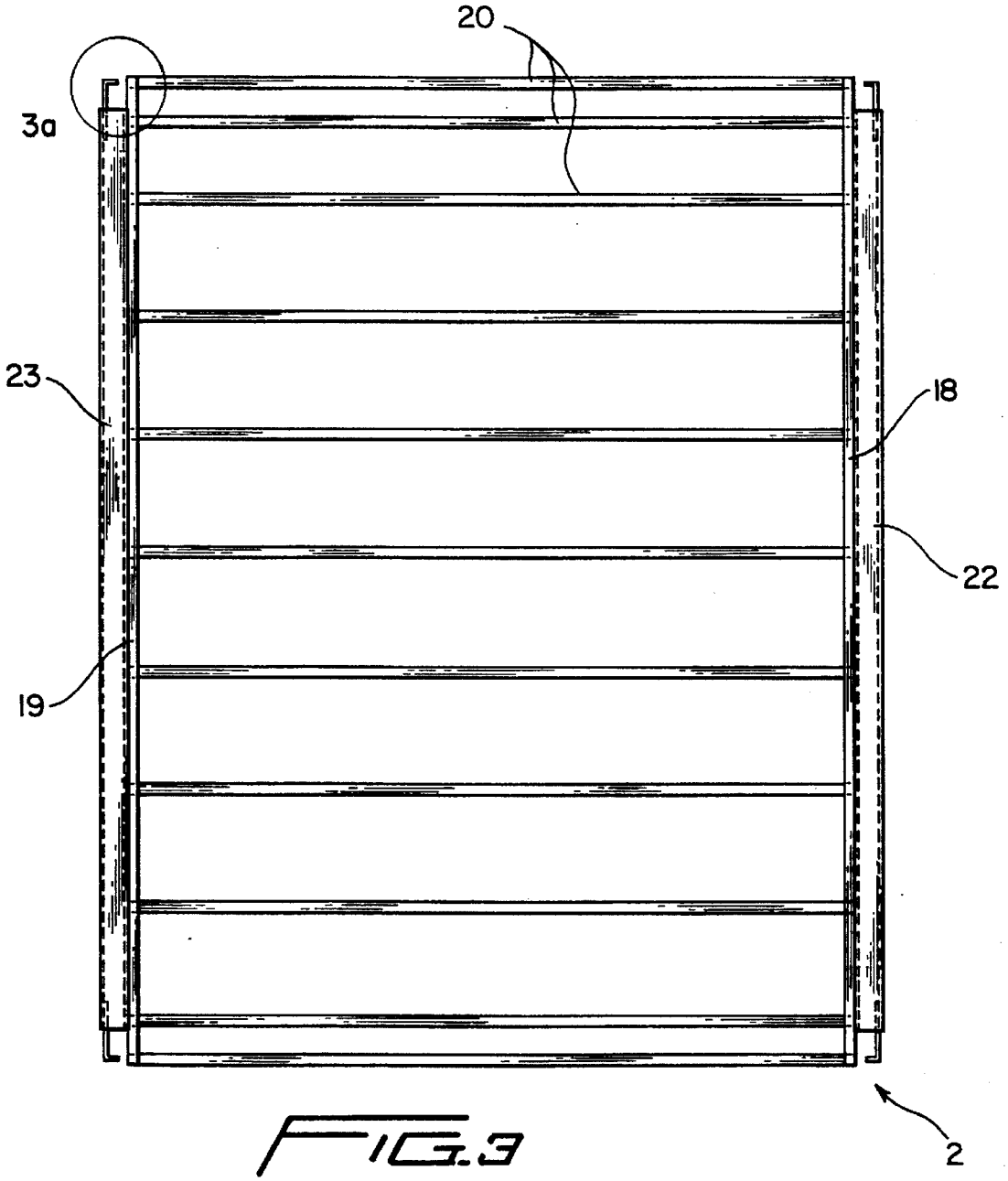
FIG. 3 is a top view of a ceiling element of the building unit.
Figure 3A:
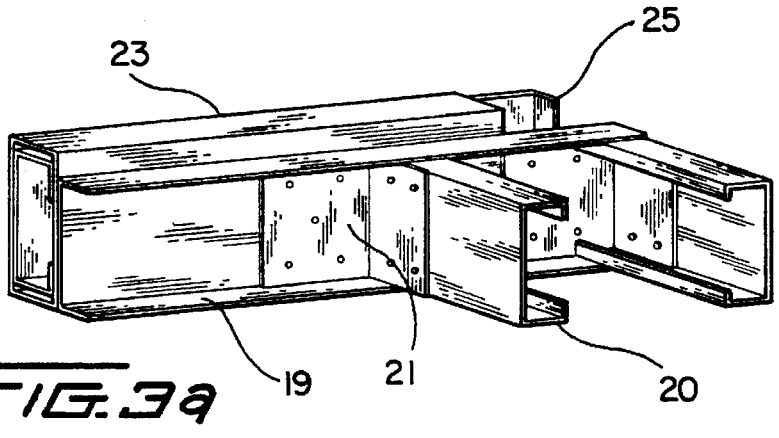
FIG. 3*a* is a perspective view of the detail 3*a* in FIG. 3.

As it appears from FIGS. 3 and 3*a*, the ceiling element 2 is constructed in a similar manner as the floor element 1 and thus comprises two longitudinal girders 18,19, wherebetween a plurality of transverse girders 20 having a C-shaped cross-section extend, said transverse girders being attached at each end to the longitudinal girders by means of angle irons 21. On the outer face of each longitudinal girder 18,19, a C-shaped iron section or side member 22,23 is arranged. At each end of the C-shaped iron sections or side members 22,23, an angular mounting 25 with a projecting angular portion is mounted on the inner side.

Figure 4:
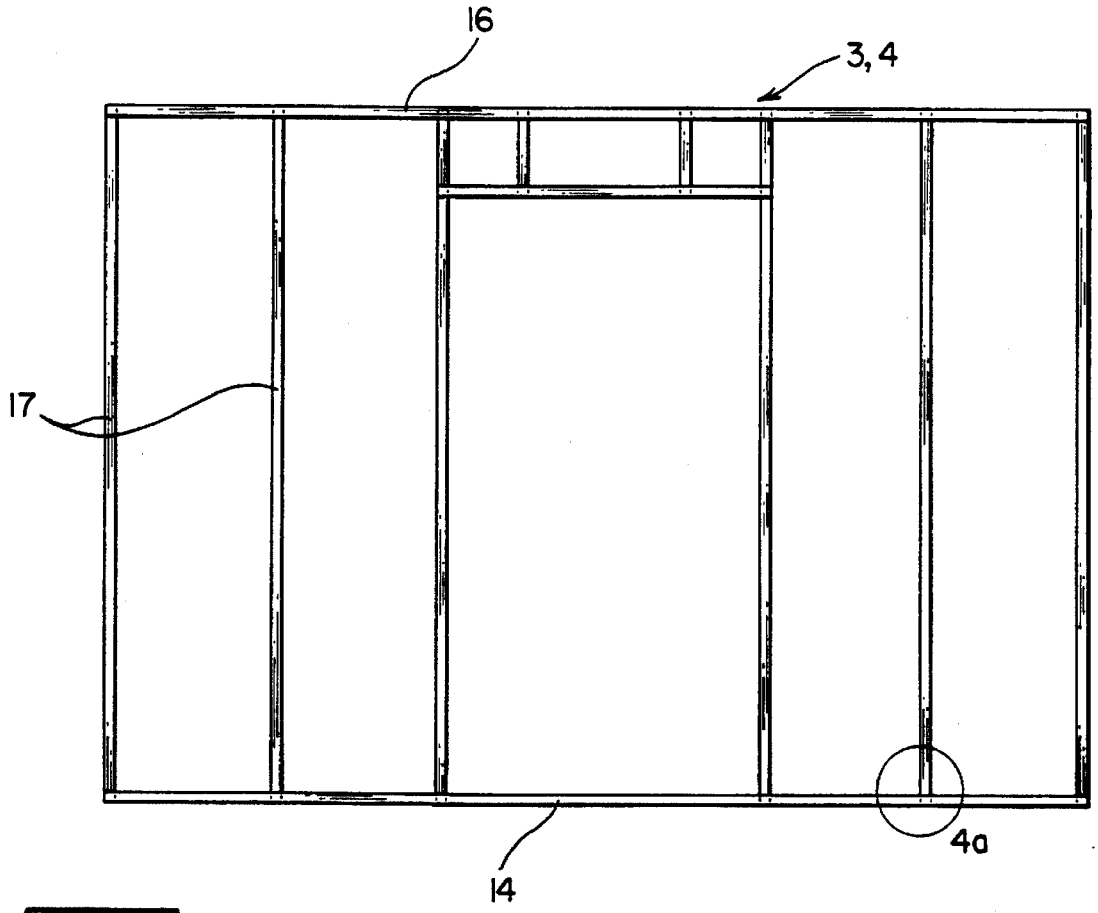
FIG. 4 is an external view of a wall element of the building unit.
Figure 4A:
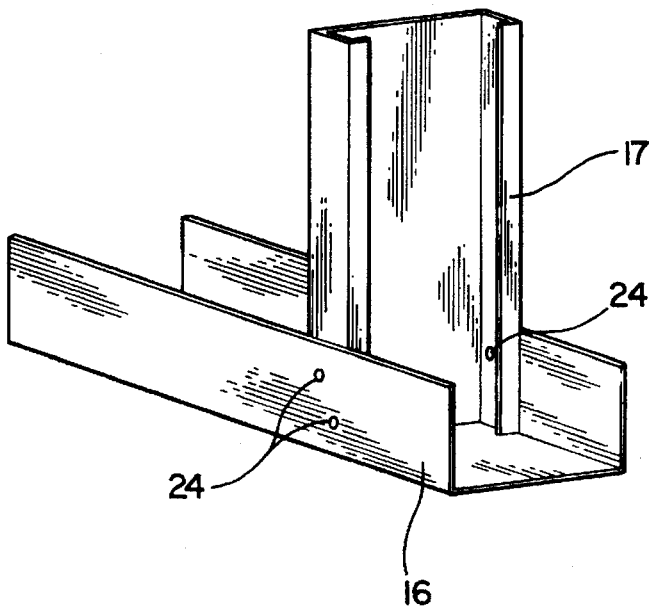
FIG. 4*a* is a perspective view of the detail 4*a* in FIG. 4.
Figure 6:
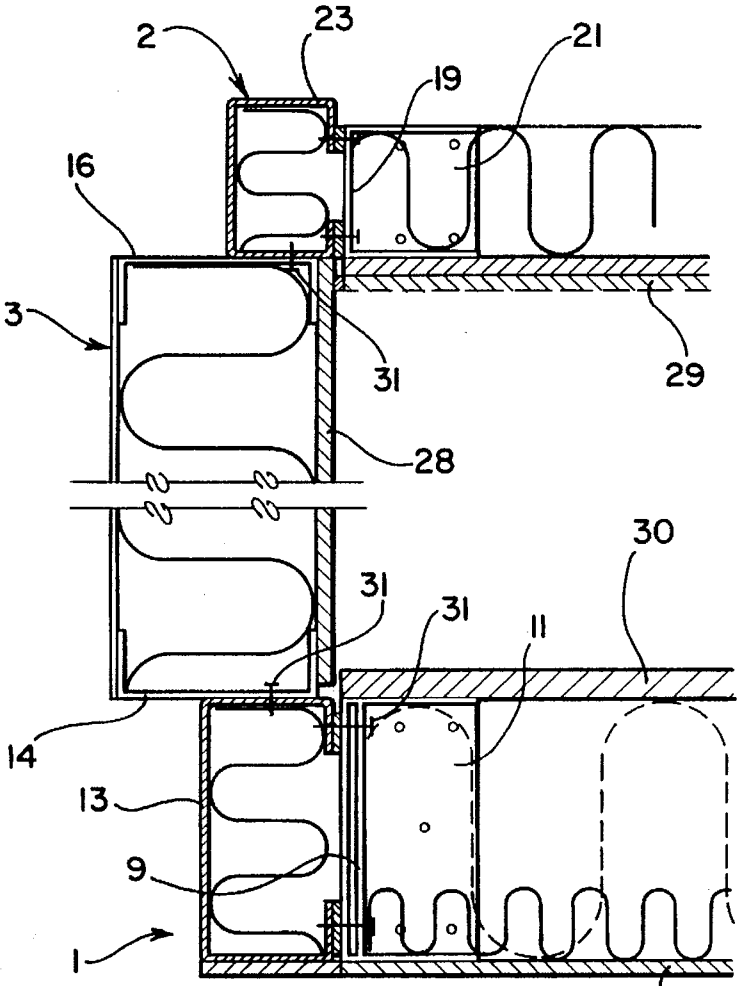
FIG. 6 is a sectional view along the line 6—6 in FIG. 1.
Figure 5:
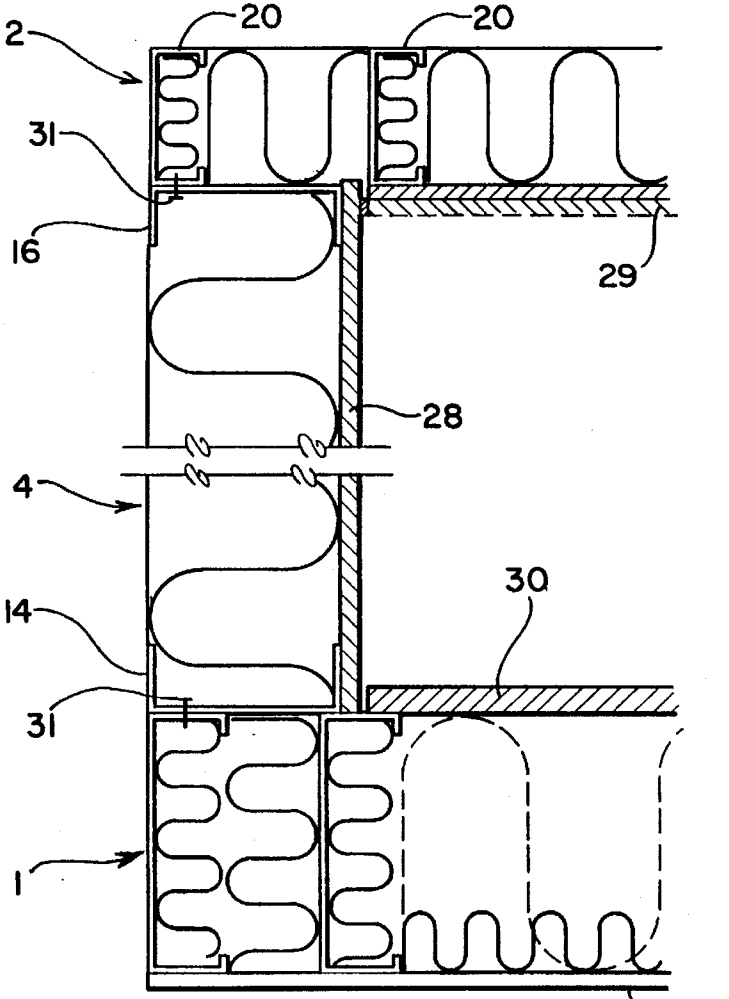
FIG. 5 is a sectional view along the line 5—5 in FIG. 1.
Figure 8:
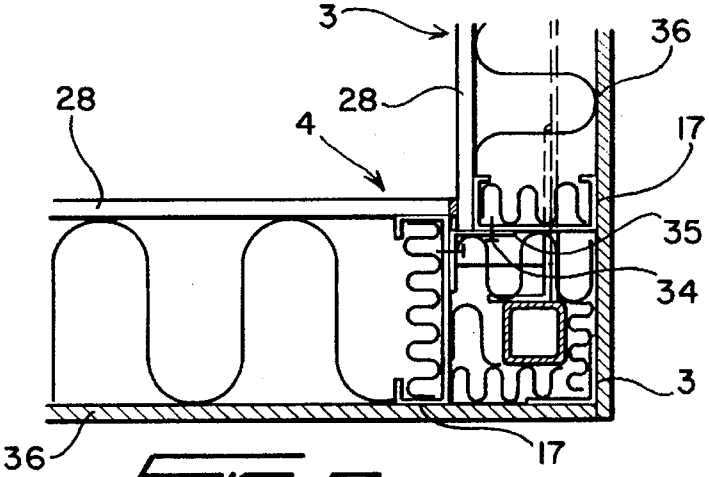
FIG. 8 is a sectional view along the line 8—8 in FIG. 1.
Figure 9:
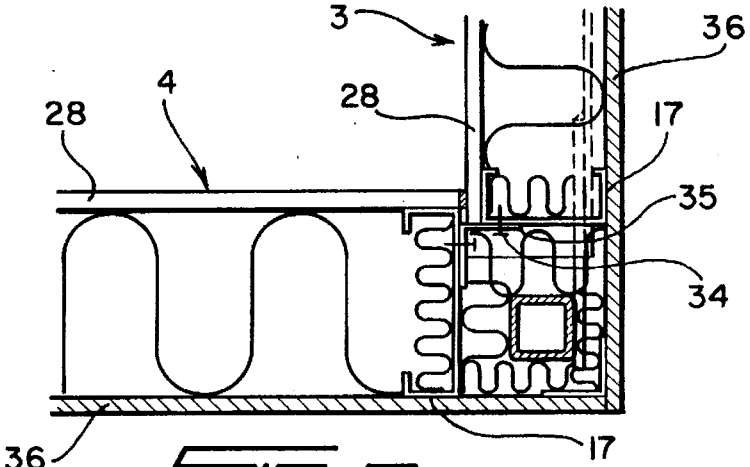
FIG. 9 is a sectional view along the line 9—9 in FIG. 1.

As seen in FIG. 4 each wall element is constructed as a lattice work of sectional iron, this being a side wall element 3 or an end wall element 4. The lattice work comprises two longitudinal, U-shaped iron sections 14,16 and a plurality of C-shaped iron sections 17 extending in between said U-shaped iron sections 14,16 and having such a width that they may be received by the cavity of the U-shaped iron sections. The C-shaped, transverse iron sections are joined to the longitudinal iron sections 14,16 by means of spot welding at reference numeral 24. The wall element shown in FIG. 4 is provided with a doorway, but depending on the object thereof, said element may of course be without an opening or be provided with one or several openings for windows, etc.

The wall elements 3,4 are provided with an inner sheating, preferably gypsum plasterboards, being screwed on to the iron sections 14, 16, 17. Correspondingly, the ceiling element 2 and the floor element 1 are provided with inner sheating. The sheating of the ceiling preferably being gypsum plasterboards screwed onto the iron section 18,19, 20 of said element, and the inner sheating of the floor element 1 preferably being chip boards screwed onto the sectional iron girder 8,9,10 thereof.

Figure 7A:
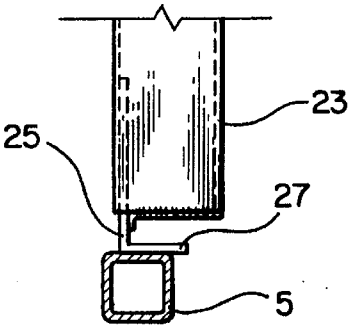
FIG. 7*a* is a sectional view along the line 7*a*—7*a* in FIG. 7.
Figure 7B:
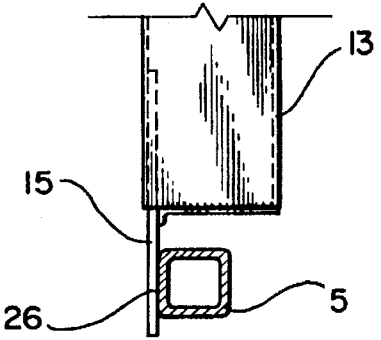
FIG. 7*b* is a sectional view along the line 7*b*—7*b* in FIG. 7.
Figure 7:
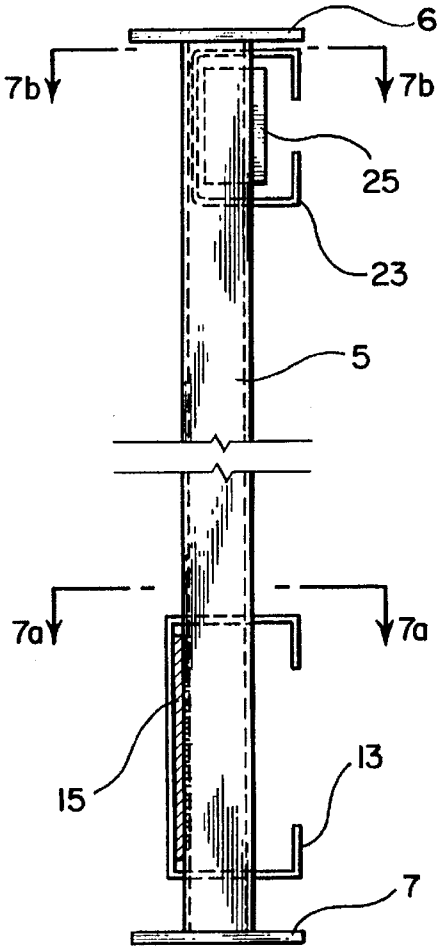
FIG. 7 illustrates a corner of the building unit seen in the direction of the arrow 7 in FIG. 1.

As it appears from FIGS. 7, 7*a* and 7*b*, the columns 5 are joined to the C-shaped iron sections or side members 12,13 of the floor element and to the C-shaped iron sections or side members 22,23 by welding of the fish plate 15 onto the end of the side member 12 to the corner column 5.

The weld between the corner column 5 and the side members 12,13 of the floor element is indicated by the reference numeral 26, while the weld between the corner column 5 and the C-shaped iron section 22,23 of ceiling element is indicated with the reference numeral 27.

Prior to the assembly of a building unit, the separate elements are completed with sheating and isolation. In the present embodiment, the wall element 3 is provided with an inner sheating 28 of gypsum plasterboards, the ceiling element 2 is provided with a double gypsum plasterboard 29 as inner sheating and the floor element is provided with an inner sheating 30 of chip boards. The floor element 1 is furthermore provided with the installations required and an outer boarding, preferably a gypsum plasterboard 33.

The building unit is assembled as follows with reference to FIGS. 5 to 9, in particular:

The floor element 1 is placed on a levelled base of steel blocks, whereafter the walls 3,4 are arranged plumb on the floor element 1, the end walls thus being supported by the outermost transverse girders 10, while the side walls 4 are supported by the C-shaped side members 12,13. The walls 3,4 are furthermore arranged abuttingly in such a manner that a vertical, through-going cavity is formed at the corners for receiving the columns 5 (confer FIGS. 8 and 9). The walls 3,4 are interconnected at the corners by means of the angle iron 32 and the self-cutting screws 31, which are passed through the angle iron and screwed into the outer C-shaped iron section 17, 17' of the adjacent walls 3,4. The joining together of the wall elements 3,4 and the floor element 1 is made by means of self-cutting screws 31 (confer FIGS. 5 and 6).

Subsequent to assembly of the walls 3,4, the ceiling element 2 is lifted downwards to abut the wall elements 3,4, the C-shaped iron section 22,23 of the ceiling element 2 being made to rest on the upper, U-shaped iron sections 16 of the side wall elements 3, while the outer transverse girders 20 are made to rest on the upper, U-shaped iron sections 16 of the end wall element 4. The ceiling element 2 is fixed to the wall elements 3,4 by means of self-cutting screws 31 (confer FIGS. 5 and 6).

Finally, the corner columns 5 are mounted by means of welding said columns to the C-shaped side members 12,13 of the floor element and to the C-shaped iron sections of the ceiling element 2.

Subsequent to mounting of the corner columns 5, the unit possesses such a rigidity that it is self-supporting and may be transported to the building site. In most cases, however, it would be advantageous, prior to transportation, to completely fit the unit with radiators, kitchen, windows, doors and other carpentry works as well as with bath/toilet, tiles, floor covering, paintwork, etc.. Furthermore, plates, preferably gypsum boarding plates 36, are mounted on the outer side of the wall elements 2,3. By such a degree of completion, the mounting on the building site may be carried out in approximately one hour.

Upon arrival at the building site, the unit is liked in place and fastened at the bottom plates of its columns by means of bolts. Due to the structure of the units, said mounting may advantageously be carried out from the outside and thus without having to enter the unit.

Subsequent to mounting of the units, the joints between the individual units are closed, for instance by means of a gypsum boarding plate.

The mounting of the units is now completed and the building may be provided with a facing of for instance facing brick.

Roofing may be performed in a traditional manner.

I claim:

1. A method of construction of a box-shaped, self-supporting building unit a plurality of which may be arranged one of juxtaposed and superposed for the construction of a building, said unit comprising a self-supporting floor element and a self-supporting ceiling element, both having a supporting structure, and two pairs of opposite wall elements as well as in each corner a supporting, vertical column of sectional iron, said vertical columns rigidly connecting the supporting structure of the floor element with the supporting structure of the ceiling element, said method comprising arranging the floor element on a levelled base, whereafter shaping and dimensioning the wall elements to bear the ceiling element, mounting and interconnecting the wall elements plumb on the floor element, subsequently, arranging and joining the ceiling element superposed on the wall elements, and finally, mounting and joining the supporting columns to the supporting structure of the floor and ceiling element.

2. A method according to claim 1, wherein the wall elements are arranged abuttingly in such a manner that a vertical cavity is formed for receiving the columns.

3. A method as claimed in claim 1, wherein the supporting structure of the floor element comprises two longitudinal bearing side members and a plurality of transverse girders arranged therebetween.

4. A method as claimed in claim 1, wherein the supporting structure of the ceiling element comprises two longitudinal bearing side members and a plurality of transverse girders arranged therebetween.

5. A method as claimed in claim 3, wherein the transverse girders at each end are connected to a longitudinal girder being connected to the bearing side member.

6. A method as claimed in claim 3, wherein the bearing side members are C-iron sections.

7. A method as claimed in claim 5, wherein the longitudinal girders are U-iron sections and the transverse girders are C- or U-iron sections with an outer sectional width essentially corresponding to the inner sectional width of the U-iron section.

8. A method as claimed in claim 1, wherein the columns have a square cross-section.

9. A method as claimed in claim 1, wherein the columns are joined to the supporting structure of the floor and ceiling elements by welding.

* * * * *